United States Patent [19]

Hatch

[11] Patent Number: 5,010,693

[45] Date of Patent: Apr. 30, 1991

[54] SELF-CONTAINED SANDBLASTING UNIT

[76] Inventor: Tobie D. Hatch, 201 Shady Shores, No. 94, Lake Dallas, Tex. 75065

[21] Appl. No.: 408,196

[22] Filed: Sep. 15, 1989

[51] Int. Cl.[5] ..... B24C 9/00; B24C 3/06; B24C 5/04

[52] U.S. Cl. ..... 51/427; 51/310; 51/424; 51/426

[58] Field of Search ..... 51/424, 426, 427, 410, 51/438, 310; 83/53, 177

[56] References Cited

U.S. PATENT DOCUMENTS

| | | | |
|---|---|---|---|
| 847,270 | 3/1907 | Wise . | |
| 1,600,415 | 9/1926 | Lansing et al. | 162/278 |
| 2,628,456 | 2/1953 | Berg | 51/8 |
| 2,840,955 | 7/1958 | Hastrup et al. | 51/8 |
| 3,618,263 | 11/1971 | Weijsenburg | 51/8 |
| 3,624,966 | 12/1971 | Palmer | 51/8 |
| 4,048,918 | 9/1977 | Peck | 101/114 |
| 4,164,183 | 8/1979 | Peck | 51/424 X |
| 4,319,524 | 3/1982 | Dunham et al. | 101/128 |
| 4,395,850 | 8/1983 | Brown | 51/427 |
| 4,624,080 | 11/1986 | Jakobsson | 51/410 |
| 4,680,899 | 7/1987 | Carpenter et al. | 51/427 |
| 4,738,174 | 4/1988 | Bloomquist | 83/177 X |
| 4,787,178 | 11/1988 | Morgan et al. | 83/53 X |

*Primary Examiner*—Frederick R. Schmidt
*Assistant Examiner*—Bruce P. Watson
*Attorney, Agent, or Firm*—Richards, Medlock & Andrews

[57] ABSTRACT

A self-contained sandblasting unit is provided. A housing having a principal body portion and an outlet body portion has a slidable support bar mounted therethrough. A nozzle is mounted on the slidable support bar such that it is capable of lateral movement through the housing. A source of compressed air and abrasive particulate matter is connected to the nozzle.

12 Claims, 3 Drawing Sheets

SELF-CONTAINED SANDBLASTING UNIT

TECHNICAL FIELD OF THE INVENTION

This invention relates to a self-contained sandblasting unit for use in etching identification markings on hardened surfaces, and is particularly directed to a self-contained sandblasting unit having a nozzle which is laterally movable across the width of the sandblasting unit.

BACKGROUND OF THE INVENTION

The use of sandblasting equipment to etch identifying markings on a hardened surface such as glass is well known. In particular, sandblasting equipment has been used in combination with an etching template in order to realize the desired marking. This technique has proven to be particularly useful in conjunction with the marking of glass articles such as windshields, side glass, and T-tops, as well as other parts of a car, thereby discouraging car thieves from stealing the "marked" car. The use of etched identification markings is also adaptable to household articles.

Self-contained sandblasting units have been disclosed. For example, U.S. Pat. No. 2,628,456 to Berg, U.S. Pat. No. 3,624,966 to Palmer, U.S. Pat. No. 4,048,918 to Peck, and U.S. Pat. No. 4,319,524 to Dunham et al. disclose sandblasting units capable of recycling abrasive material after it has contacted the etching surface. Recirculation of the abrasive particulate matter is desirable in order to obviate the uncontrolled scattering of abrasive material commonly associated with standard sandblasting techniques.

The optimal etching effect of a sandblasting unit is realized when the abrasive particulate material is directed perpendicularly to the etching surface. In this way, a deeper and more accurate groove or etch is created.

SUMMARY OF THE INVENTION

The self-contained sandblasting unit of the present invention includes a housing having a principal body portion and an outlet body portion. A sandblasting nozzle is mounted for lateral movement within the principal body portion such that it is able to direct a stream of compressed air and abrasive material through the opening defined by the outlet body portion. In operation, a stream of compressed air and abrasive material is directed across the width of the opening in the outlet body portion by moving the nozzle laterally across the width of the unit. In this way, abrasive material contacts the etching surface along a substantially perpendicular path across the width of the opening.

BRIEF DESCRIPTION OF THE DRAWINGS

A more complete understanding of the present invention and its advantages will be apparent from the following detailed description read in conjunction with the accompanying drawings, in which.

DETAILED DESCRIPTION

Figure 1:
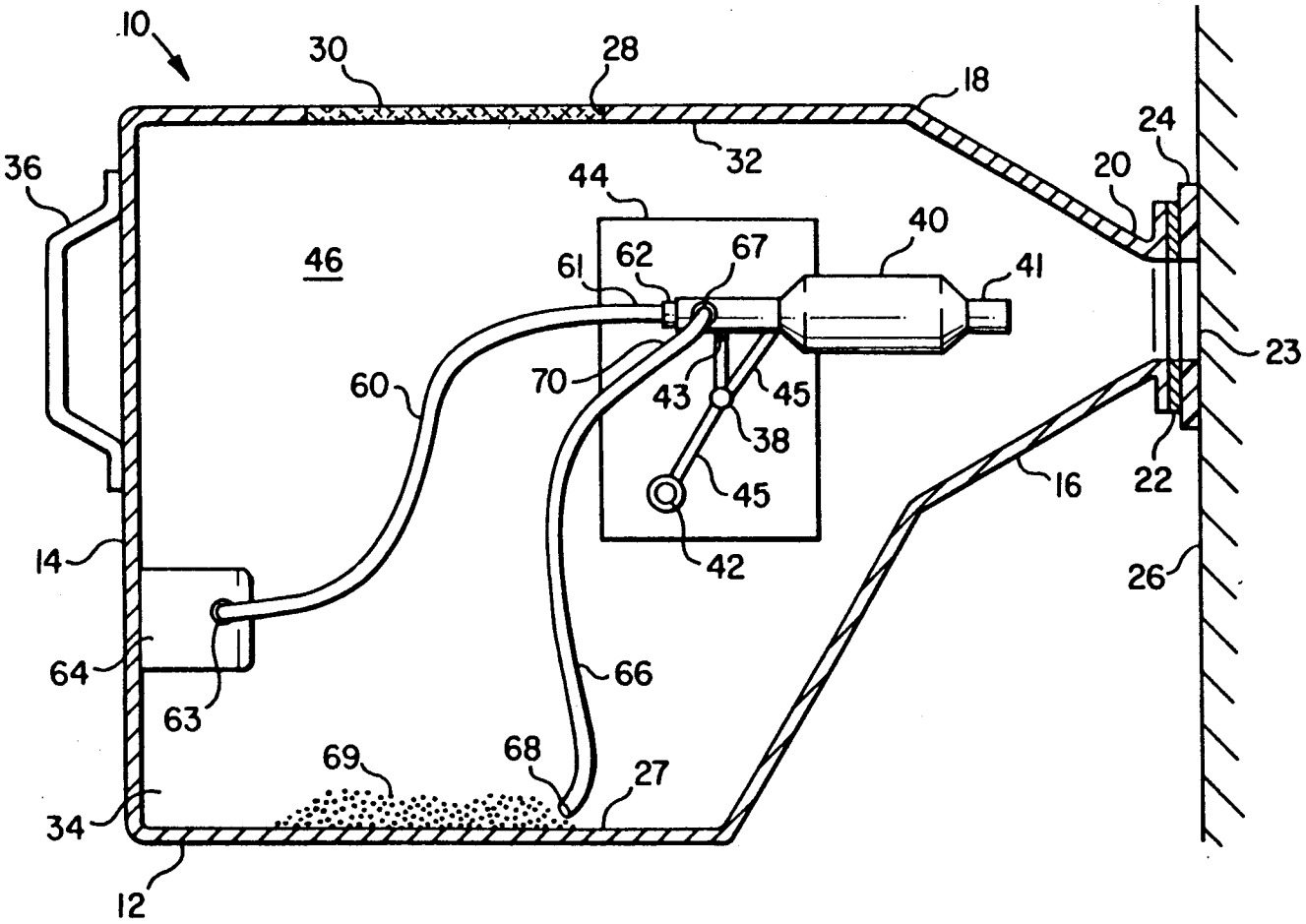
FIG. 1 is a partial cross-sectional view of the self-contained dampening system of the present invention.
Figure 2:
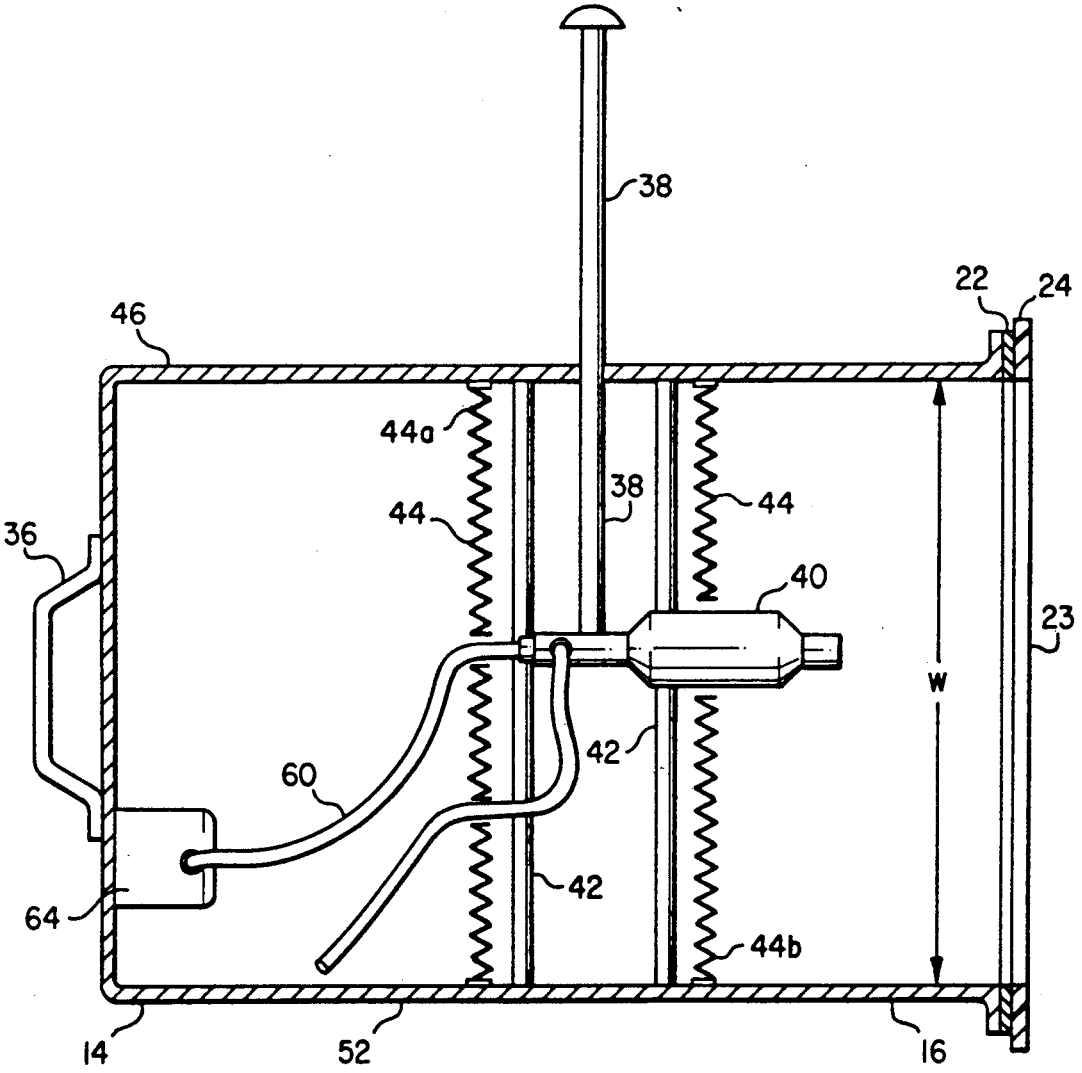
FIG. 2 is a top cross-sectional view of the self-contained sandblasting unit.

The self-contained sandblasting unit of the present invention is generally indicated at 10 of FIG. 1. Housing 12 of sandblasting unit 10 includes principal body portion 14 and outlet body portion 16. Outlet body portion 16 has a proximal end 18 and a distal end 20. In the preferred embodiment, the peripheral dimension of housing 20 decreases from proximal end 18 of outlet body portion 16 to distal end 20. However, width w of outlet body portion 16 is preferably constant along its length. Distal end 20 defines opening 23 in housing 12. Opening 23 provides a pathway through which abrasive particulate material contained in housing 12 can be directed toward the surface to be etched. The width $w_1$ of opening 23 is preferably equal to the width w of outlet body portion 16.

In one embodiment of the present invention, tip 22 is attached to distal portion 20 of outlet body portion 16. Tip 22 can be permanently affixed to housing 12. In the alternative, it has been found to be desirable to provide housing 12 with a removable tip 22, thereby permitting sandblasting unit 10 of the present invention to be used in conjunction with various surface configurations. A flexible gasket 24 preferably is mounted on tip 22 about opening 23 of housing 12. Flexible gasket 24 provides a seal between etching surface 26 and housing 12, thereby preventing the abrasive particulate material contained in housing 12 from scattering following contact with etching surface 26. As a result, the abrasive particles are reflected into housing 12 and fall to bottom surface 27 after they have collided with etching surface 26.

Air vent 28 is defined in principal body portion 14. Air vent 28 provides an escape for the compressed air directed through the unit 10, a feature which is necessitated by the substantially air-tight seal formed between flexible gasket 24 and etching surface 26. Air filter 30 is mounted in air vent 28, thereby preventing the escape of abrasive particulate matter from the interior of housing 12 through air vent 28 during the etching process. It is desirable that upper surface 32 of principal body portion 14 be removable in order to facilitate access to air filter 30 and interior 34 of housing 12.

Housing 12 also includes a handle 36 mounted on principal body portion 14 at a position distal from said outlet body portion 16.

As depicted in FIG. 1, a support bar 38 is slidably mounted through side wall 46 of principal body portion 14. A nozzle 40 is mounted on slidable support bar 38 within housing 12. Nozzle 40 is mounted such that its outlet 41 is aimed through opening 23 of outlet body portion 16. In the preferred embodiment depicted in FIG. 1, nozzle 40 is mounted at the same elevation as opening 23, thereby enabling nozzle 40 to direct a stream of compressed air and abrasive particulate material therethrough.

In an alternative embodiment, nozzle 40 is pivotally mounted on slidable support bar 38. In this embodiment, nozzle 40 can be disposed on support bar 38 at any desired angle and secured in that position by means of a threaded fastener 43.

Slidable support bar 38 can be laterally oscillated across the width of principal body portion 14, thereby permitting nozzle 40 to direct a stream of compressed air and abrasive particulate matter across the width $w_1$ of opening 23. It will be appreciated that this configuration enables the self-contained sandblasting unit of the present invention to provide a substantially perpendicular stream of abrasive material to etching surface 26 across the width $w_1$ of opening 23. In this way, unit 10 provides an optimal and consistent etching effect across the width of opening 23.

Protective covering 44 is mounted about slidable support bar 38 in order to prevent the abrasive particulate from interfering with the mechanical operation of slidable support bar 38. It is desirable that protective covering 44 not interfere with the mechanical operation of slidable support bar 38. Thus, in a preferred embodiment, protective covering 44 comprises a flexible, pleated expansible piece of elastomeric material which operates in an accordion-like fashion. Protective cover 44 is sealed to side wall 46 of housing 12 at its first end 44*a*. The second end 44*b* of protective cover 44 is affixed to plate 50 mounted adjacent to nozzle 40 on slidable support bar 38. In this way, slidable support bar 38 is isolated from the internal environmental conditions of housing 12 and, more importantly, will not be subjected to the abrasive effects of the particulate material.

In one embodiment of the present invention, bearing support bars 42 are horizontally disposed across the interior of principal body portion 14 between side wall 46 and side wall 52. In this embodiment, support bars 45 are affixed to nozzle 40 and are slidable on rigid support bars 42, thereby providing additional stability and support for nozzle 40.

When bearing support bars 42 are present, it is necessary that protective cover 44 also isolate support bars 42 in order to prevent the abrasive particulate material from interfering with the sliding of support bars 45 along bearing support bars 42. In this embodiment, first end 44*a* of protective cover 44 is affixed to side wall 46 of housing 12 and second end 44*b* of protective cover 44 is affixed to side wall 52 of housing 12. In this embodiment, nozzle 40 is mounted on slidable support 38 and through protective cover 44. Accordingly, an airtight seal is also provided between nozzle 40 and protective cover 44 at the point that nozzle 40 protrudes through protective cover 44. In this way, slidable support bar 38 and bearing support bars 42 are protected from the abrasive particulate material within housing 12.

First end 61 of compressed air tube 60 is connected to nozzle 40 at connection point 62. Second end 63 of compressed air tube 60 is attached to compressed air source 64, thereby providing a source of compressed air to nozzle 40. A second tube 66 is attached to nozzle 40 at point 67. Distal end 68 of second tube 66 is free to move about within housing 12. Second tube 66 has a sufficient length such that distal end 68 is constantly in contact with abrasive particulate matter 69 disposed along the bottom surface 27 of housing 12. In operation, compressed air is directed through compressed air tube 60 and into nozzle 40. Due to the resulting flow of air through nozzle 40, a vacuum is created at proximal end 70 of second tube 66, thereby creating a flow from distal end 68 to proximal end 70 through second tube 66. Abrasive particulate matter 69 disposed along the bottom surface 27 of housing 12 is thus drawn through second tube 66 and into nozzle 40. At this point, the compressed air and abrasive particulate matter are mixed in nozzle 40 and are then expelled at high speed through outlet 41 of nozzle 40. As discussed in detail above, the resulting stream of compressed air and abrasive particulate matter are directed through opening 23 in outlet body portion 16 such that the stream engages etching surface 26 at a substantially perpendicular angle.

Figure 3:
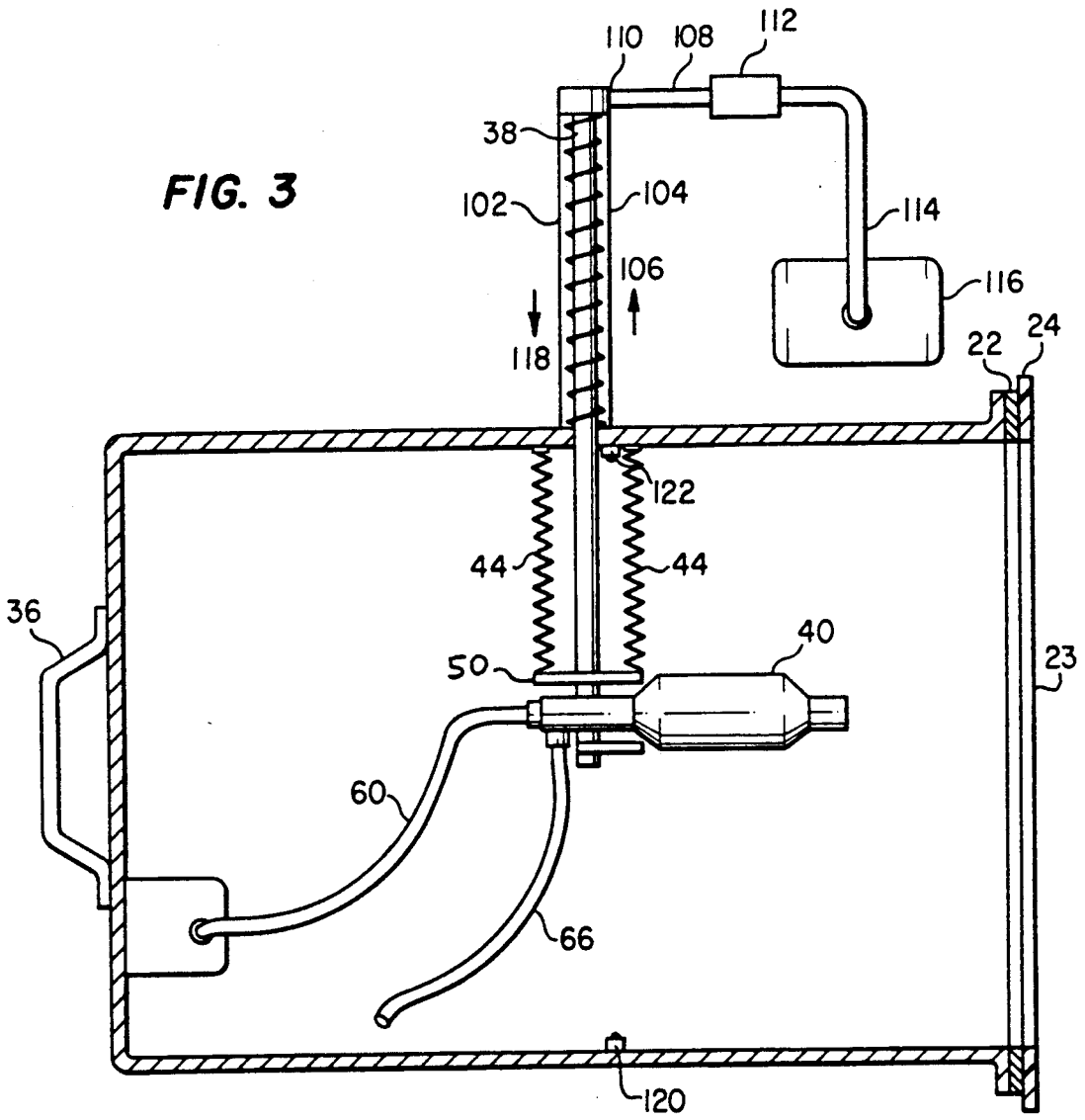
FIG. 3 is a top cross-sectional view of a preferred embodiment of the self-contained sandblasting unit of the present invention.

In order to etch across the width of opening 23, it is necessary to move nozzle 40 laterally. Accordingly, slidable support bar 38 is caused to oscillate laterally through housing 12. In one embodiment, this lateral oscillation of slidable support bar 38 is performed by manually moving slidable support bar 38. In an alternative embodiment, lateral oscillation of support bar 38 is possible through the use of pneumatic and mechanical means. As best seen in FIG. 3, slidable support bar 38 is disposed within housing 102. Housing 102 is preferably air tight and provides additional stability to slidable support bar 38. Spring 104 is mounted within housing 102 and bears against slidable support bar 38 with a force having a direction indicated by arrow 106 in FIG. 3. Pneumatic tube 108 is connected to the interior of housing 102 at distal end 110. A valve 112 is mounted within pneumatic tube 108 and is able to alternately open and close pneumatic tube 108. Distal end 114 of pneumatic tube 108 is connected to a pressurized air source 116.

When valve 112 is open, pressurized air is delivered to distal end 110 of housing 102, thus causing slidable support bar 38 to bear against spring 104. As the pressure at distal end 110 increases, slidable support bar 38 is forced in the direction indicated by arrow 118 in FIG. 3. Slidable support bar 38 eventually reaches switch 120 mounted on side wall 52, causing valve 112 to close. Spring 104 then forces slidable support bar in the direction indicated by arrow 106. However, when slidable support bar 38 engages second switch 122 mounted on side wall 46, valve 112 is returned to its open position, once again causing compressed air to be directed into housing 102. In this way, slidable support bar 38 is caused to oscillate through housing 12. It is to be appreciated that valve 112, switch 120, and second switch 122 may be operated either mechanically or electrically.

While the self-contained sandblasting unit of the present invention has been described in detail herein with respect to specific preferred embodiments, it will be evident that various and further modifications are possible without departing from the true spirit and scope of the present invention.

I claim:

1. A self-contained sandblasting unit comprising:

a housing, said housing having a principal body portion and an outlet body portion, said outlet body portion having a proximal end and a distal end, said outlet body portion defining an opening therethrough at said distal end thereof whereby the interior of said housing is in communication with the external environment of said housing through said opening, said proximal end of said outlet body portion being connected to said principal body portion;

a slidable support bar mounted through said principal body portion whereby said support bar is laterally slidable through said principal body portion;

a means for isolating said slidable support bar from the interior environment of said housing;

a nozzle, said nozzle mounted on said slidable support bar whereby said nozzle is directed through said opening defined through said distal end of said outlet body portion, and whereby said nozzle is laterally slidable through said principal body portion;

a compressed air source attached to said nozzle; and a particulate matter source connected to said nozzle whereby a stream of compressed air and particulate matter is directed through said nozzle and through said opening defined through said distal end of said outlet body portion at a constant angle as said nozzle is moved laterally through said principal body portion.

2. The self-contained sandblasting unit of claim 1 wherein a flexible molding is mounted on the exterior of said outlet body portion of said housing about said opening defined through said distal end of said outlet body portion.

3. The self-contained sandblasting unit of claim 1 further comprising a tip portion releasably attached to said distal end of said outlet body portion about said opening defined through said outlet body portion.

4. The self-contained sandblasting unit of claim 1 wherein a template is attached to said outlet body portion across said opening defined through said outlet body portion.

5. The self-contained sandblasting unit of claim 1 wherein an air vent is defined through said housing, said air vent having a filter mounted therein whereby particulate matter cannot exit said housing through said air vent.

6. The self-contained sandblasting unit of claim 5, wherein said air vent is defined through said principal body portion.

7. The self-contained sandblasting unit of claim 1 wherein said means for isolating said slidable support bar from the interior environment of said housing comprises a plated, expansible piece of elastomeric material.

8. The self-contained sandblasting unit of claim 1 wherein said slidable support bar is pneumatically operated whereby said slidable support bar is oscillated laterally upon the application of a pneumatic force.

9. The self-contained sandblasting unit of claim 1 wherein said compressed air source comprises a tube having a first end and a second end, said first end of said tube being attached to said nozzle, said tube passing through said housing, and said second end of said tube being attached to a compressed air chamber.

10. A self-contained sandblasting unit comprising:

a housing, said housing having a principal body portion and an outlet body portion, said outlet body portion having a proximal end and a distal end, said outlet body portion defining an opening at said distal end thereof whereby the interior of said housing is in communication with the external environment of said housing through said opening defined through said distal end, said proximal end of said outlet body portion being connected to said principal body portion;

a slidable support bar mounted through said principal body portion whereby said support bar is laterally slidable through said principal body portion;

a nozzle, said nozzle mounted on said slidable support bar whereby said nozzle is directed through said opening defined through said distal end of said outlet body portion, and whereby said nozzle is laterally slidable through said principal body portion such that said nozzle is directed through said opening defined through said distal end of said outlet body portion at a constant angle as said nozzle is moved laterally through said principal body portion;

a first tube having a first end and a second end, said first end of said first tube being connected to said nozzle, said second end of said first tube being connected to a compressed air source;

a second tube having a first end and a second end, said first end of said second tube being connected to said nozzle and said second end of said second tube disposed within said housing whereby abrasive particulate matter within said housing is drawn through said nozzle by a stream of air directed through said first tube; and a means for isolating said slidable support bar from the interior environment of said housing, whereby particulate matter in said housing is prevented from interfering with the operation of said slidable support bar.

11. The self-contained sandblasting unit of claim 10 wherein said means for isolating comprises a pleated, expansible piece of elastomeric material.

12. The self-contained sandblasting unit of claim 10 wherein said slidable support bar is pneumatically operated whereby said slidable support bar is oscillated laterally upon the application of a pneumatic force.

* * * * *